US006471549B1

(12) United States Patent
Lappöhn

(10) Patent No.: US 6,471,549 B1
(45) Date of Patent: Oct. 29, 2002

(54) SHIELDED PLUG-IN CONNECTOR

(76) Inventor: Jürgen Lappöhn, Im Enter 3, D-73108 Gammelshausen (DE)

( * ) Notice: Subject to any disclaimer, the term of this patent is extended or adjusted under 35 U.S.C. 154(b) by 0 days.

(21) Appl. No.: 09/868,147

(22) PCT Filed: Oct. 18, 2000

(86) PCT No.: PCT/EP00/10275

§ 371 (c)(1),
(2), (4) Date: Jun. 15, 2001

(87) PCT Pub. No.: WO01/29931

PCT Pub. Date: Apr. 26, 2001

(30) Foreign Application Priority Data

Oct. 18, 1999 (DE) ..... 199 50 275

(51) Int. Cl.[7] ..... H01R 13/648

(52) U.S. Cl. ..... 439/608; 439/101; 439/610; 439/108

(58) Field of Search ..... 439/608, 609, 439/610, 607, 108, 101

(56) References Cited

U.S. PATENT DOCUMENTS 4,914,062 A 4/1990 Voltz
5,238,414 A 8/1993 Yaegashi et al.
6,231,391 B1 * 5/2001 Ramey et al. ..... 439/608
6,247,970 B1 * 6/2001 Ueno et al. ..... 439/608

FOREIGN PATENT DOCUMENTS

GB 2315614 2/1998
WO 9926321 5/1999

* cited by examiner

*Primary Examiner*—Tho D. Ta
*Assistant Examiner*—Truc Nguyen
(74) *Attorney, Agent, or Firm*—Friedrich Kueffner

(57) ABSTRACT

A shielded plug-in connector has a jack-in-blade strip having at least one first contact element and an edge connector having at least one second contact element corresponding to the first contact element. The edge connector, on or in its outer body areas, has at least partially shielding sheets. Shielding of the plug-in connector is achieved by, in addition to the shielding sheets provided on the edge connector, a shielding group with at least one first element arranged in the jack-in-blade strip. The first element of the shielding group is a base part in the form of a U-shaped rail. The shielding sheets on the edge connector have a planar body and angled stays. Two of the angled stays and a portion of the planar body between the two angled stays form a counterpart to the base part, wherein the counterpart and the base part together substantially encapsulate the first and second contact elements.

10 Claims, 12 Drawing Sheets

410
412
500
94
55
400
419
418
411
504
401
901
901
901
U
H
L
R
V
O
Rk

SHIELDED PLUG-IN CONNECTOR

BACKGROUND OF THE INVENTION

1. Field of the Invention

The invention relates to a shielded plug-in connector, in particular, a multi-pole, single-row or multi-row plug-in connector, preferably comprised of a jack-in-blade strip and an edge connector, with which electrical lines, in particular, lines of electronic components or assemblies, in particular, circuit boards, are connected with one another, preferably in a detachable way.

2. Discussion of the Related Art

In known plug-in connectors shields for a single-pole or also multi-pole plug-in connector are designed such that the plug part and/or the socket part, the jack-in-blade and/or the edge connector, are provided with large surface area shielding sheets mounted externally or internally on their housing parts. This type of shielding is effective for interference signals that act from the exterior on the plug part. For shielding individual contact elements which are, in particular, arranged in multiple rows and, moreover, in a multi-pole plug-in connector provided for the aforementioned application, the known type of shielding is not effective, in particular, when via the contact elements connecting the lines high-frequency signals are to be transmitted. The users of the aforementioned plug-in connectors therefore always pose in this respect higher requirements; at the same time there is the permanent requirement for reduced manufacturing costs as well as miniaturization of the contact distances and size of the plug-in connectors.

Therefore, it is an object of the invention to develop such a plug-in connector with shielding, in particular, a plug-in connector comprised of a jack-in-blade strip and edge strip (s), such that also for minimal spacings of the contact elements of the jack-in-blade strip and edge connector relative to one another, as present in the so-called 2-mm plug-in connectors, a sufficient shielding of individual contact elements, a contact pin and/or a contact spring or group of same is ensured and such that the plug-in connector or its components can be produced with a reduced expenditure.

SUMMARY OF THE INVENTION

This object is solved according to the invention by a shielded plug-in connector wherein the shielding of the plug-in connector is comprised of, in addition to the shielding sheets provided on the edge connector, a shielding group comprised of at least one first element, wherein this first element is arranged in the jack-in-blade strip. The dependent claims disclose advantageous further developments as well as embodiment variants of the basic new configuration of important components of the plug-in connector, in particular, of its new shielding group.

The invention is based on a shielded plug-in connector, in particular, a multi-pole, single-row or multi-row plug-in connector, comprised preferably of a jack-in-blade strip and edge connector, wherein the jack-in-blade strip has at least one first contact element in the form of a contact pin and the edge connector has at least one second contact element which corresponds to the first contact element and is in the form of a contact spring. In this plug-in connector the edge connector is provided, on or within its external body areas, at least partially with shielding sheets. New and decisive in regard to the subject matter of the invention is that the shielding of the plug-in connector is realized in addition to the shielding sheets provided on the edge connector and comprised of a shielding group which is comprised of at least one first element, wherein this first element is arranged in the jack-in-blade strip. A further development resides in that the first element of the shielding group is a base part whose basic shape is preferably a U-shaped rail. The basic shape of the base part can however have any envelope-shaped or sleeve-shaped form, but the mantle surface may not be closed; it has preferably a longitudinal slot. Experiments by the inventors have shown that the aforementioned U-shape is an advantageous embodiment.

According to another embodiment the shielding group is comprised of a base part and a counterpart.

Preferably, it is furthermore provided that the counterpart of the shielding group is an integrated component of one of the shielding sheets of the edge connector. Moreover, it is preferably provided that the base part of the shielding group laterally surrounds at least one contact pin, in particular and preferably two contact pins of the jack-in-blade strip essentially substantially completely while leaving open a preferably upwardly extending gap.

The advantages of the invention reside, in particular, in that the parts of the new shielding group for the jack-in-blade strip and for the edge connector can be produced as simple bent components, in particular because particularly partial areas thereof can be formed with minimal expenditure to a springy area and, moreover, a base part and a counterpart can be produced of a basic shape, wherein the partial areas thereof facing one another when inserting both parts, in particular their upper and lower end faces, deviate from one another only slightly with respect to their configuration so that the manufacturing expenditure can be kept low. A further advantage results when using the base part of the new shielding group for multi-pole and multi-row plug-in connectors. Even though the basic element of the new shielding group, the U-shaped base part, has only three walls, the contact pins, even for an open plug-in connector, at least those in the following row of contact pins, are shielded by a fourth shielding wall, substantially all-around, because the back wall of the base part/base parts of the preceding row forms the aforementioned fourth shielding wall.

BRIEF DESCRIPTION OF THE DRAWINGS

The invention will be explained in more detail with the aid of embodiments which at the same time illustrate further advantages of the invention. The drawings show in this connection in a schematic illustration in:

FIGS. 4 to 4*c* the new shielding group which is comprised of a base part and a corresponding counterpart;

FIG. 4 the base part of the new shielding group which is shown here upright in a perspective view;

FIGS. 4*a* to 4*c* the base part and the counterpart in different phases during plugging in;

FIG. 13 a perspective view from the rear onto the two-row edge connector;

FIG. 14 one of the two base bodies of the edge connector according to FIG. 13, with shielding elements arranged on both sides;

FIG. 15 the front housing part of the two-row edge connector in a perspective view;

FIG. 16 the front housing part according to FIG. 15 with an inserted base body covered on both sides;

FIG. 17 the rearward housing part of the two-row edge connector according to FIG. 13; and FIG. 18 in a perspective view the parts of the two-row edge connector during the plug-in process for assembly.

DESCRIPTION OF PREFERRED EMBODIMENTS

Figure 1:
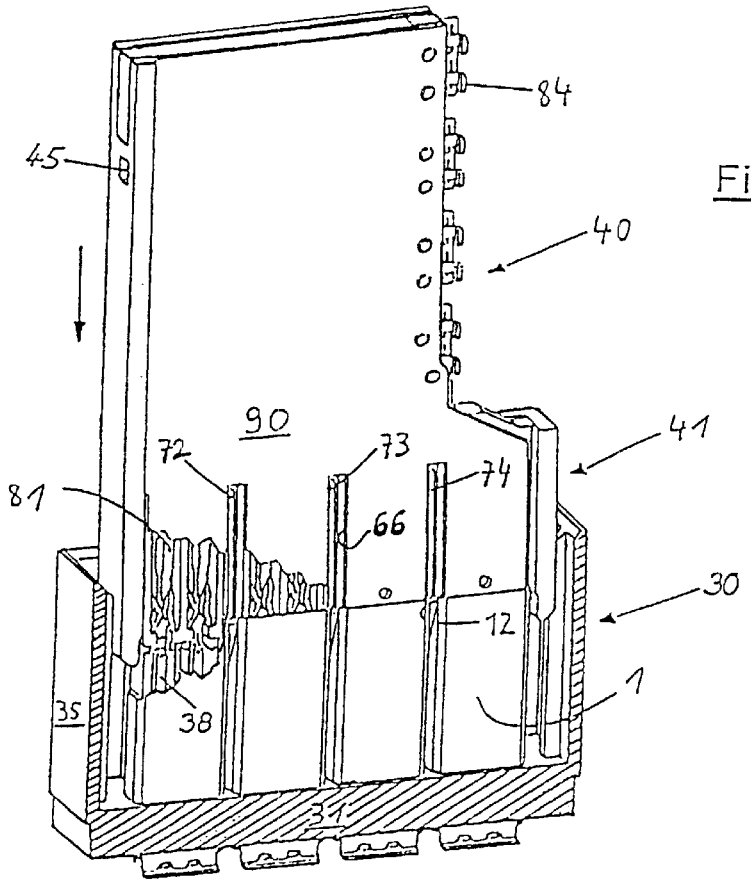
FIG. 1 the new plug-in connector in an embodiment jack-in-blade strip/edge connector during plugging in of an edge connector onto the contact pins of a jack-in-blade strip.
Figure 3:
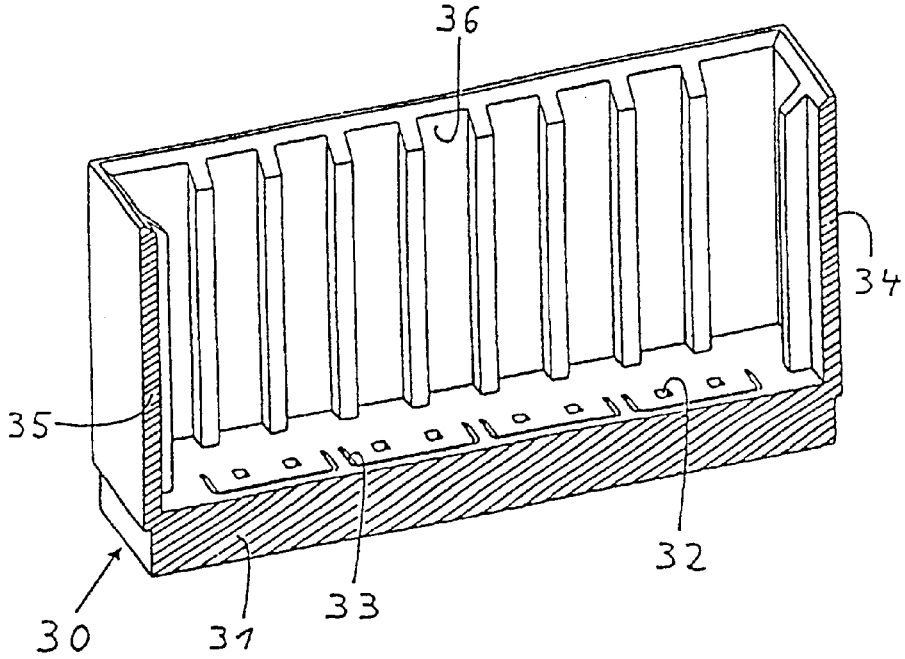
FIGS. 2 and 3 a known jack-in-blade strip of a plug-in connector which is provided with elements of a new shielding group.
Figure 2:
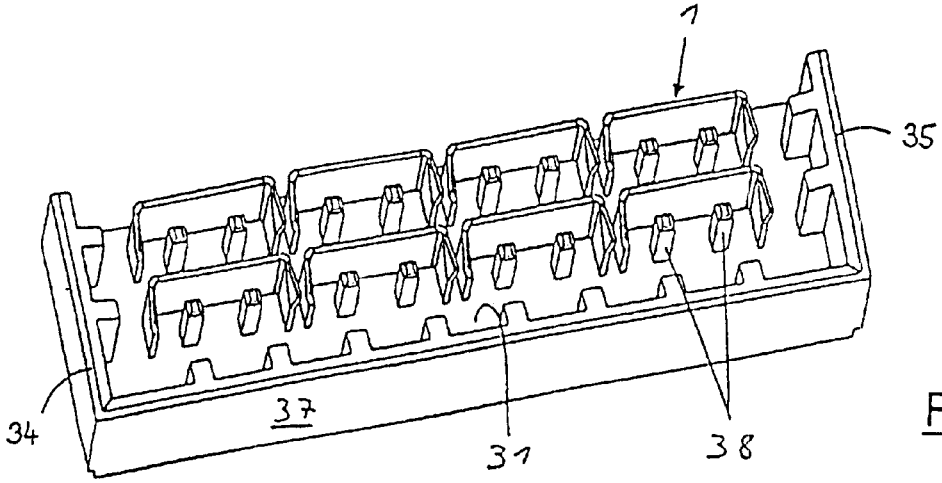

In FIG. 1, the new shielded plug-in connector is shown in an embodiment of a jack-in-blade strip/edge connector during plugging in of the edge connector 40 onto contact pins of the jack-in-blade strip 30. For improved illustration, the edge connector 40 in this illustration is sectioned transversely. An upper cover 90 of the edge connector 40 is partially broken away in FIG. 1, also a back wall of the base parts 1 so that in this illustration the position of the contact pins 38 and of the contact springs 80, in particular, their front spring part 81, can be seen. The terminal tabs of the contact springs of the edge connector 40 are identified by 84. The jack-in-blade 30 is comprised in a manner known in the art of a socket 31, sidewalls 34 and 35, as well as a front wall and back wall which are connected with the sidewalls 34, 35 and the socket 31 in a positive-locking way. For the purpose of material and weight savings, the sidewalls, front wall, and back wall are of a thin wall configuration and are stabilized by inwardly projecting, upwardly extending stays which are illustrated but not identified in FIGS. 1 through 3. The edge connector 40—shown during plugging in according to the direction of the arrow—is in a position immediately before contacting of the spring parts 81 of the contact springs 80 with the contact pins 38. The housing 41 of the edge connector 40 is position-secured in the jack-in-blade strip 30 by the stabilizing pins which are not identified. The new shielding group according to the invention for this embodiment of the new plug-in connector is comprised in particular of a base part 1, illustrated in FIG. 4. This base part 1, configured preferably as a U-shaped part, is preferably arranged in the jack-in-blade strip 30. In an advantageous embodiment, as illustrated in FIGS. 1 through 3, several base parts 1 are provided for the contact pins 38 arranged in a row wherein two neighboring contact pins have correlated therewith one base part 1, respectively. The sidewalls of neighboring base parts 1 are spaced from one another with formation of a free space, not identified. Corresponding to the position of the base parts 1, slots, not identified, are provided in the upper cover 90 of the edge connector 40 which are provided counter to the plug-in direction but along the same in the upper cover 90 and have a length which matches the length of the base parts 1. In this illustration—FIG. 1—the stays 72, 73 and 74 of the shielding sheet 70 of the edge connector 40, projecting into the aforementioned slots, are shown as well as the grooves 66 provided in the base body of the same 40, which extend, respectively, so as to correspond to the slots provided in the upper cover 90 as well as to the stays 72, 73 and 74. During and upon completion of the plug-in action of the edge connector 40 into the jack-in-blade strip 30, one of the sidewalls of neighboring base parts 1 is positioned adjacent to the angled stays 72, 73 and 74, illustrated here. The further and detailed configuration of the base parts as well as of the parts provided within the edge connector 40 of the new shielding group will be explained in the following with the aid of FIGS. 2 to 4*c* as well as FIG. 12.

FIG. 2 shows the jack-in-blade strip 30 in a perspective view from above with a viewing direction onto the contact pins 38 as well as onto base parts 1 of the new shielding group shielding a group of two contact pins 38 on three sides, respectively. The sidewalls are identified with 34 and 35, the back wall with 37 and the socket with 31. In this illustration of the jack-in-blade strip 30, the front wall, which is here oriented to the rear, is separated from the same by a vertical section, for the purpose of space saving for the illustration. In the FIG. 3 shown above FIG. 2 the jack-in-blade strip 30 is rotated by 180° relative to the FIG. 2. The vertical section extends here behind the first row of base parts 1 in comparison to FIG. 1. The onlooker looks onto the inner wall 36 of the base of the back wall 37. In the socket 31 several slots 33 are provided which surround on three sides a group of two receiving holes 32 for the contact pins 38, respectively. In these receiving slots 33 a base part 1 with its lower area 6 is inserted, respectively, and preferably locked in place.

Figure 4:
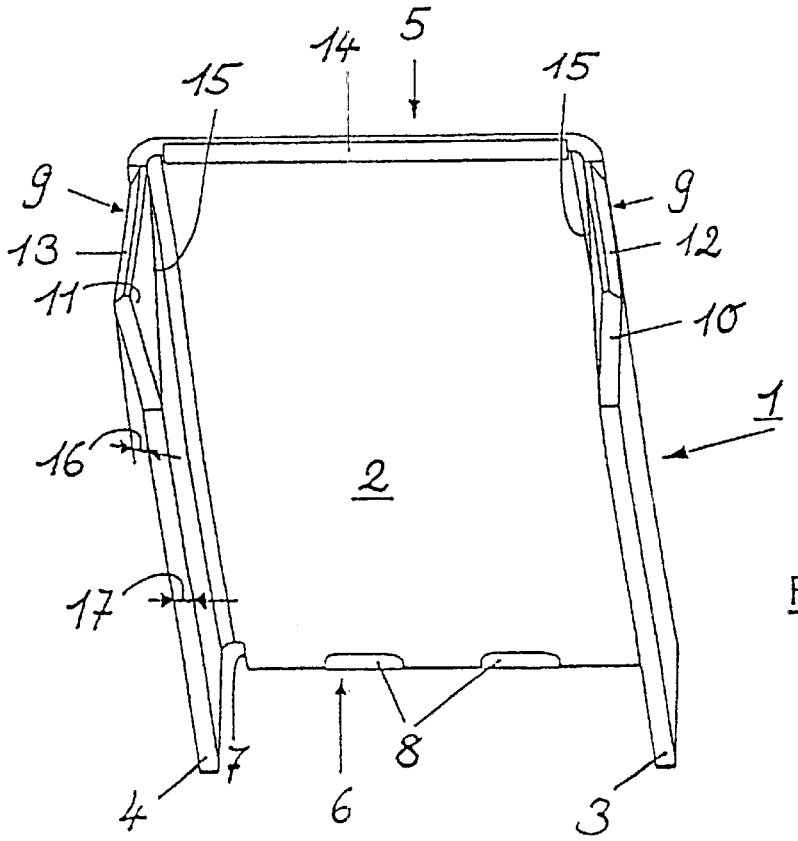

The base part 1 of the new shielding group is illustrated in detail in FIG. 4 in a preferred embodiment. It is a U-shaped rail, having a back wall 2, a left sidewall 4, and a right sidewall 3. In the head area 5 and in the foot area 6 the rail is open, respectively. In the foot area 6 the sidewalls 3 and 4 are somewhat set back in the direction toward the head area 5 so that at the back wall 2 a stay-shaped step 7 results. In the area of this stay-shaped step 7 in the inner surface of the back wall 2 in the vicinity of the lower edge, at least one, in this special embodiment two, depressions 8 are provided in which, in particular, a locking member can snap into place which is preferably positioned in the socket 31 of the jack-in-blade strip 30 but is not illustrated in the Figures. The sidewalls 3 and 4 have in the head area 5 a corner part 10 and 11, respectively, which is bent outwardly with lateral displacement 16. The corner parts 10 and 11 are bent outwardly about the bending line 15 so that the upper corner, formed by the horizontal and vertical outer edges of the sidewall 3 and the sidewall 4, projects farthest to the exterior, respectively. The upper, outer horizontal edge of the corner part 10 and of the corner part 11 is provided respectively with a slant 12 or 13 along the aforementioned edge. The upper, inner edge of the back wall 2 has also such a slant 14. The base parts 1 comprised of shielding material surround on three sides a contact group, comprised respectively of two contact pins 38, of a row of contact pins 38. In the embodiment illustrated in FIG. 2 in the second row of contact pins 38 and in each further row of contact pins 38 each group of contact pins comprised of two contact pins 38 is shielded on three sides by the respectively correlated U-shaped base parts 1; the fourth side is at the same time shielded by the back wall 2 of a base part 1 which is arranged in the preceding row. The contact pins 38 in the front row of contact pins 38, directly arranged at the front wall 37, is shielded relative to the fourth side at least by the housing shielding provided on the insertable plug-in edge connector 40.

With the employed new shielding group which is comprised of at least one, preferably several, base parts, which are provided at least in the jack-in-blade strip in the aforementioned form, signal-guiding contacts or contact groups of a jack-in-blade strip and edge connector are shielded even better than in the prior art from outer electrical, magnetic, or electromagnetic interference fields, respectively, the radiation of electromagnetic high-frequency vibrations to the exterior is at least greatly reduced.

Figures 4A, 4B, 4C:
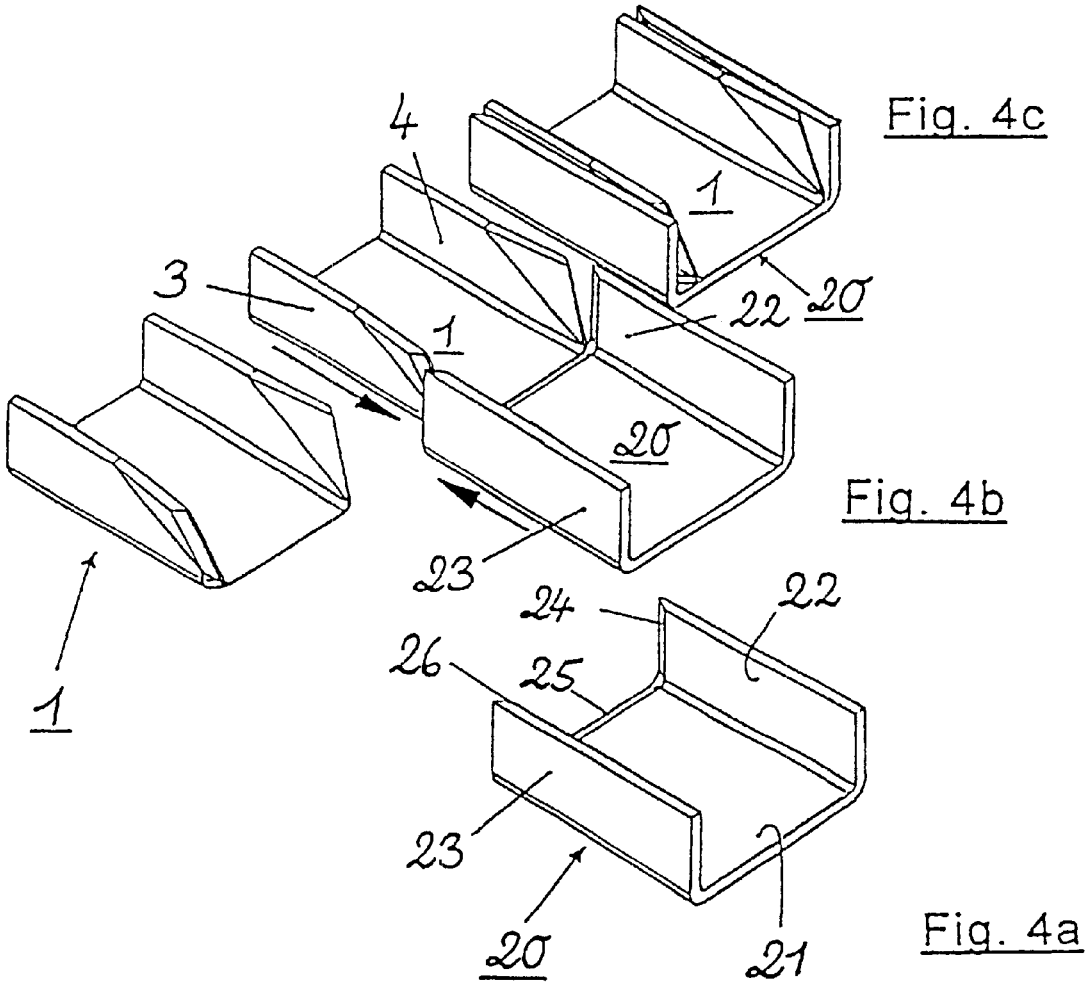

When the effectiveness of the shielding is to be further increased, the invention further provides that another assembly correlated with the plug-in connector, generally an edge connector 40, a counterpart 20 is provided which is matched to the U-shaped base part 1 of the new shielding element and is illustrated in FIGS. 4*a* to 4*c* and is comprised of a back wall 21 as well as two sidewalls 22 and 23. It is moreover sized such that the base part 1, the U-shaped rail, can be inserted into the counterpart 20 which is also embodied as a U-shaped rail, wherein the corner parts 10 and 11 of the base part 1 act like a spring element and rest in a positive-locking connection inwardly at the sidewalls 22 and 23 and glide along them 22 and 23 during the plug-in process. For facilitating the illustration, the counterpart 20 is illustrated in a position rotated by 180° about its longitudinal axis so that the insertion movement is shown in the drawing.

The sidewalls 22 and 23 as well as the back wall 21 of the counterpart 20 are provided in the edge area of their foot area at the inner side with a slant 24, 25, 26, respectively. These slants 24, 25, and 26 as well as the slants 12, 13, and 14 provided in the head area 2 of the base part 1 act as guiding surfaces and facilitate the interconnection of the parts of the new shielding group.

Figure 5:
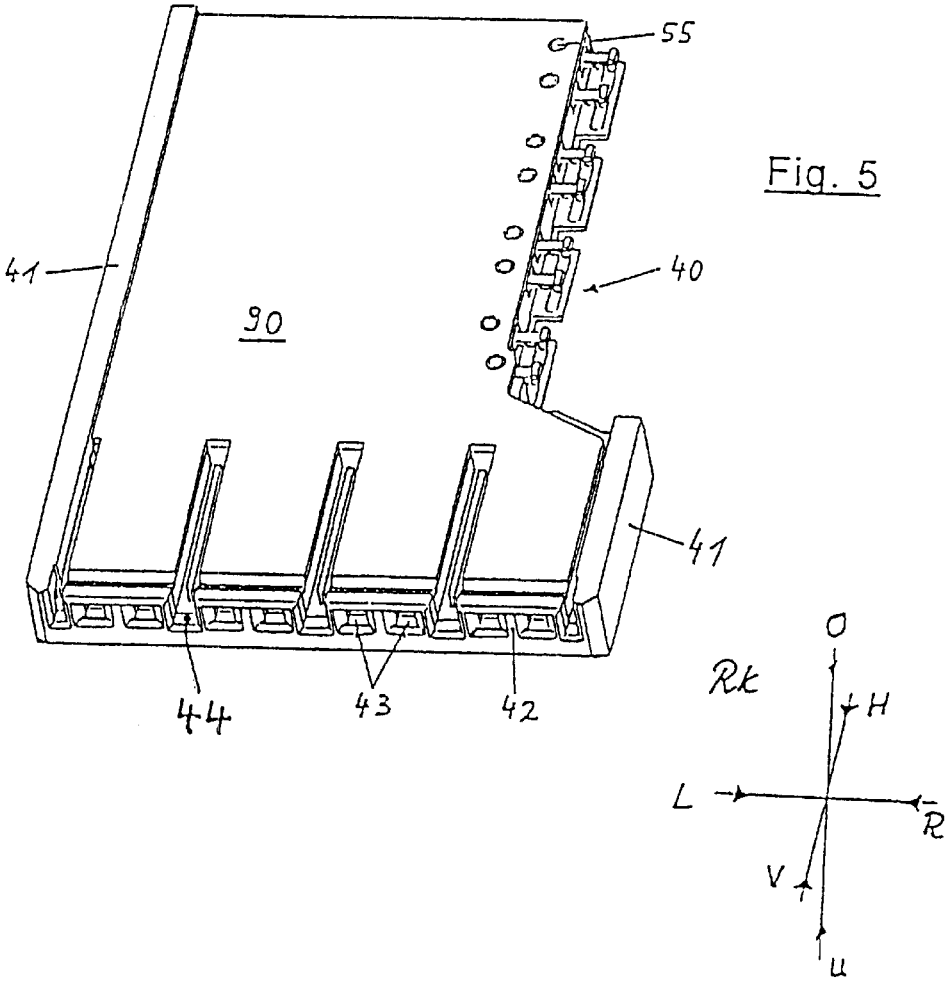
FIG. 5 a perspective view of an edge connector for the new plug-in connector.
Figure 6:
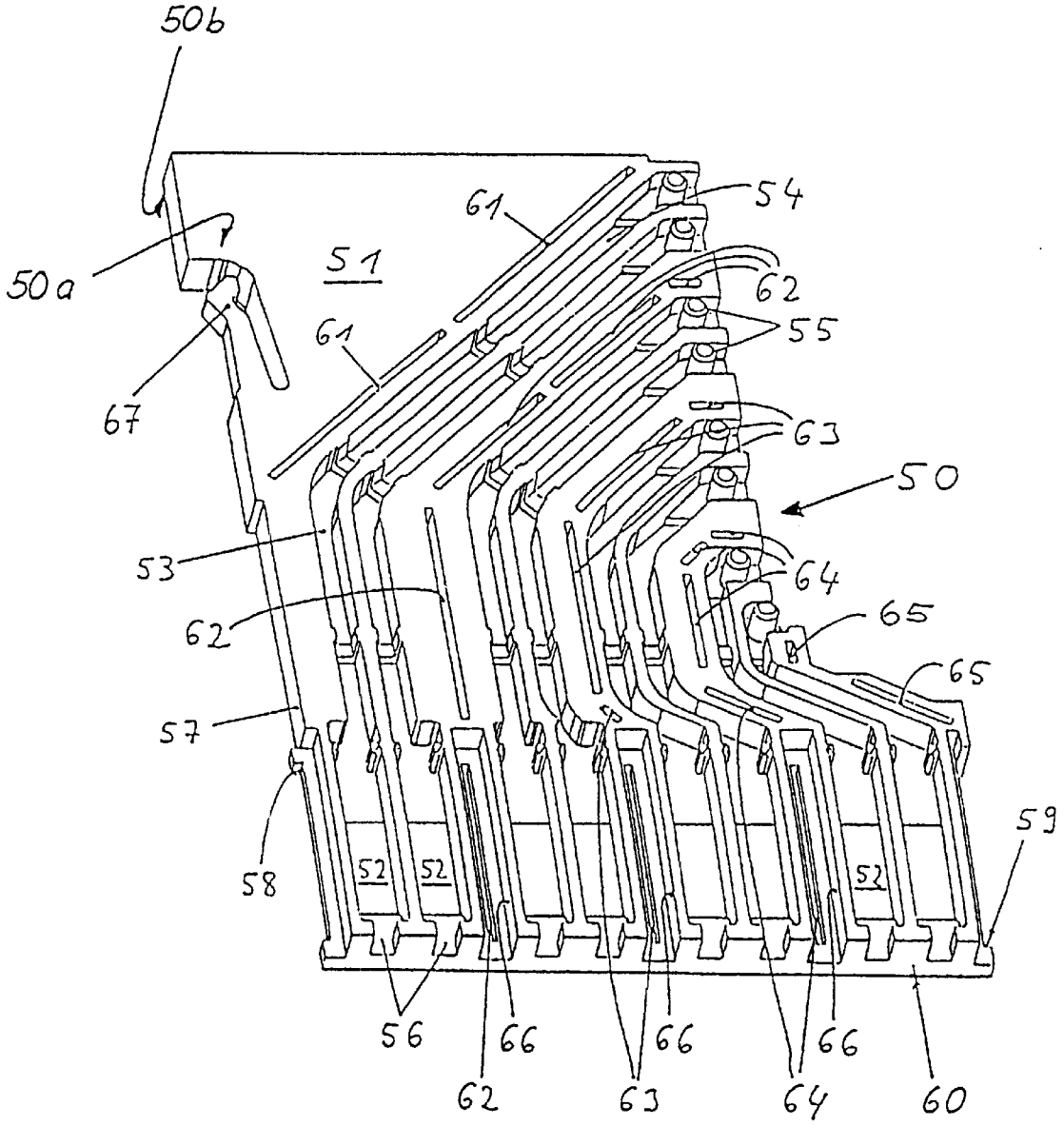
FIG. 6 the base body for the new edge connector according to FIG. 5 in an advantageous variant.

In a modified form and an embodiment important to the invention, the counterpart 20 is an integrated component of the shielding sheet 70 of the edge connector 40. This development of the invention is illustrated in FIGS. 5 through 12. In FIG. 5 the complete edge connector 40 is illustrated in a perspective view. For facilitating the orientation for the following description, the FIG. 5 has correlated therewith a three-axis coordinate system for the identification of the body surfaces of the edge connector 40, respectively, its individual parts. The reference characters arranged on the coordinate system "RK" have the following meaning: "V"—viewing direction from the front; "H"—from behind; "L"—from the left; "R"—from the right; "O"—from above; and "U"—viewing direction from below. In a housing 41 the individual parts of the edge connector 40 are shown. The housing 41 is closed by an upper cover 90 which is provided with an insulating layer and a shielding layer. At the end face of the housing 41 a front part 42 is provided which comprises several, sleeve-shaped inlets 43 adjacently arranged in a row into which 43 the contact pins 38 of the jack-in-blade strip 30 can be inserted. After each second sleeve-shaped inlet 43 a groove 44 is provided which opens the front part 42 in the upward direction and which will be explained in more detail at a later point. Moreover, at the left part of the housing 41 a locking hole 45 is provided at the rearward area; illustration in FIG. 1. The pins for positioning and fixation of the upper cover 90 are identified by 55. The right center and right rearward part of the side surface of the edge connector 40 is recessed to the left to such an extent that the terminal tabs of the contact guiding elements of the edge connector, projecting to the right from the edge connector 40, can be connected at, on or in a circuit board so that the circuit board after fastening preferably does not project past the right lateral surface of the housing 41. The size of this partial recesses of the right lateral edge of the edge connector depends on the conventional standard values of the respective application situation. In FIG. 6 a basic body 50 of the edge connector 40, in FIG. 7 the inventive new configuration of the shielding sheet 70 correlated with the base body 50, in FIG. 8 the contact springs 8, and in FIG. 10 the upper cover of the edge connector 40 are illustrated in detail.

The base body 50 has channels 52, 53, and 54 extending from the upper surface 50*a* and machined into the body which are sized such that the contact springs 80 can be received therein. The channels 52 to 54 are arranged such that the respective end areas 84 of the inserted contact springs 80 project from the right lateral surface of the edge connector 40, i.e., relative to a forward surface 60 they are displaced by 90°. Starting at the forward surface 60 in which several openings 56 are provided the rearwardly extending front channel 52 adjoins, followed by a central channel 53 and a rearward channel 54. The forward channel 52 is somewhat wider than the two other channels 53 and 54 because in this forward channel 52 the corresponding spring part 81 of a contact spring 80 is positioned. The center part 82 of the contact spring 80 is positioned in the central channel 53 and the end part 83 of the contact spring 80 in the rearward channel 54. In the end part 83 a hole 85 is provided which is slipped over a pin 55 provided in the rearward channel 54 so that the contact spring 80 is fixed at the same time in the longitudinal direction. In the channels 52, 53 and 54 several stays, not identified, are provided laterally and at the bottom of the respective channel so that each inserted contact spring 80 is spaced relative to the base body 50 and rests therein 50 multiple times but only with point contact so that over substantial body areas between base body and contact spring 80 a large area air buffer is provided; see FIG. 6 in this context. This air buffer effects an additional shielding of each contact spring 80.

Figure 7:
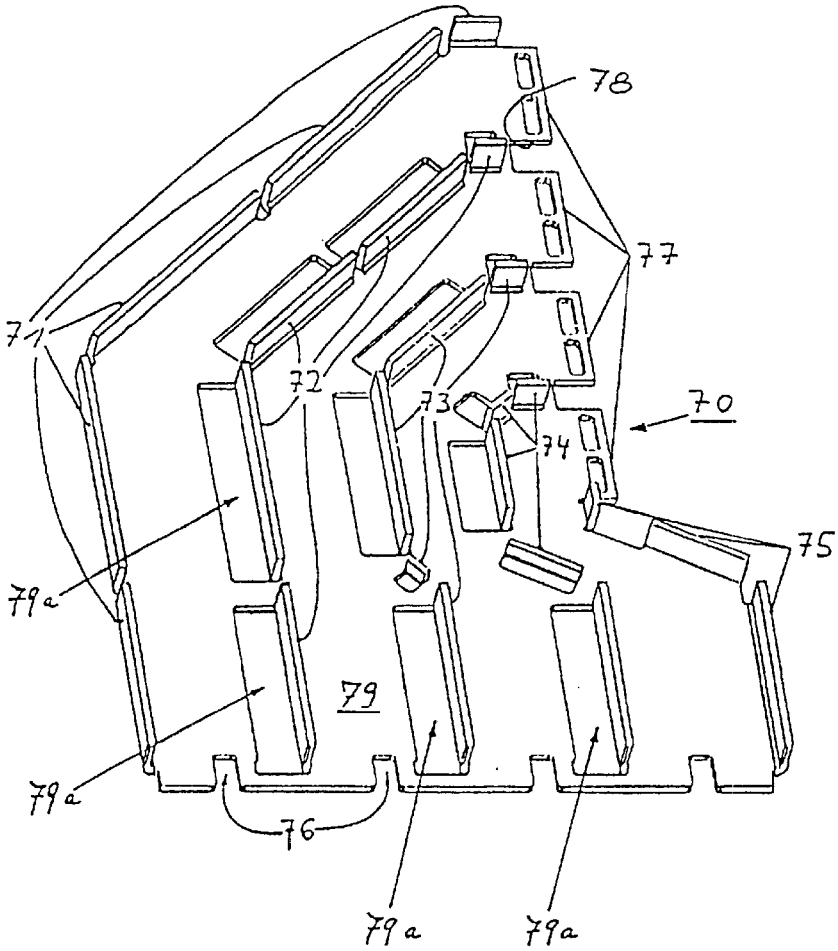
FIG. 7 shows the shielding sheet belonging to the base body according to FIG. 6 with integrated base parts of the new shielding.
Figure 8:
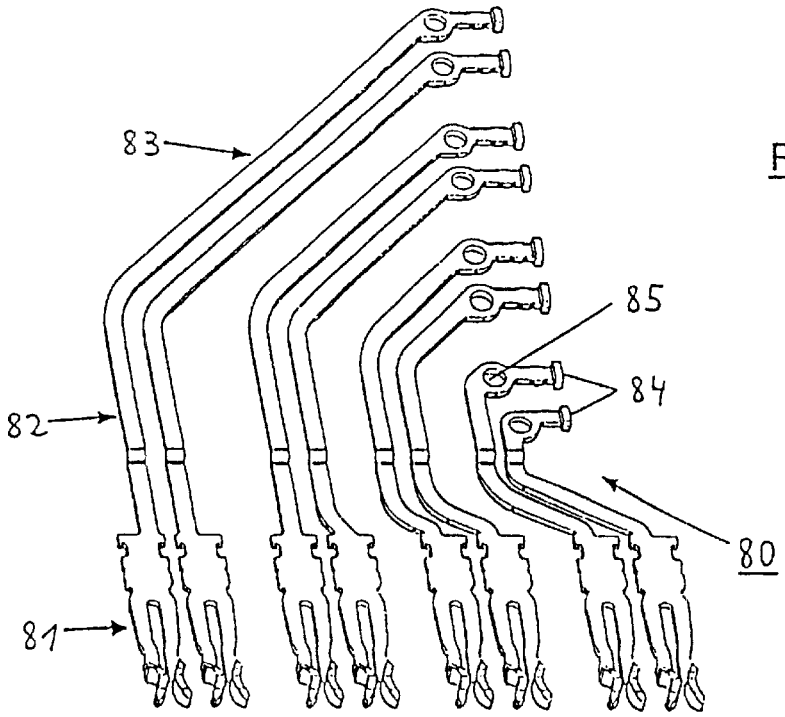
FIG. 8 contact springs for the edge connector according to FIG. 5.

Moreover, in the base body 50 grooves 66 are provided which begin at the forward surface 60 and are positioned between a pair of front channels 52, respectively. Laterally and parallel to each pair of adjacently positioned channels 52, 53, and 54, slot-shaped penetrations 61, 62, 63, 64, and 65 are provided in the base body 50. They penetrate same from the bottom to the top. These penetrations serve for receiving parts of the shielding sheet 70 positioned at the bottom surface 50*b* of the base body 50 which sheet will be explained in more detail in the following. To the left and the right on the base body 50 lateral cutouts 57, 58, 59 are provided which also serve for receiving parts of the aforementioned shielding sheet 70. By means of the contact springs 80 beginning at the forward surface 60 and fitted substantially longitudinally in the base body and exiting laterally from the base body, a contact free area 51 is provided at the rearward part of the base body. In this area 51, as illustrated in FIG. 6, laterally a locking hook 67 is provided which, after assembly of all parts of the edge connector 40, snaps into place in a locking hole 45 of the base body 41, as illustrated in FIG. 1. The shielding sheet 70 corresponding to the edge connector 40, which is inserted into the housing 41 and onto which 70 the base body 50 is slipped, as illustrated in FIG. 7. In a new configuration according to the invention, the shielding sheet 70 has integrated therein the counterpart 20 of the novel shielding group. In realization of the object of the invention with respect to lowering the manufacturing-technological expenditure, the planar body 79, the base part of the shielding sheet 70 is provided with angled upwardly projecting stays 71, 72, 73, 74 and 75. These stays 71 to 75 result from a three-sided continuous stamping in the planar body 79 and subsequent bending of the tabs formed by stamping into a respective position—plane—which is positioned approximately 90° relative to the planar body 79. The position as well as the size of these stays depends on the conditions of the respective edge connector 40 and are arranged corresponding to the slot-shaped penetrations 61 to 65, respectively, the lateral cutouts 57 to 59 in the base body 50 of the corresponding edge connector 40. Respective neighboring stays or rows of stays and the part positioned therebetween of the planar body 79 form thus a counterpart 20 for the novel shielding group. A counterpart 20 is thus formed of a stay 71 and a stay 72 and an area of the planar body 79 positioned between them as well as a stay 72 and 73, a stay 73 and 74 as well a stay 74 and 75 and the respective area arranged between these stays of the planar body 79, respectively. At the right side, in the central and rearward area, the shielding sheet 70 has projections 77 separated from one another by cutouts 78 which serve for contacting the circuit board connectable thereto and not illustrated in the Figures.

Figure 9:
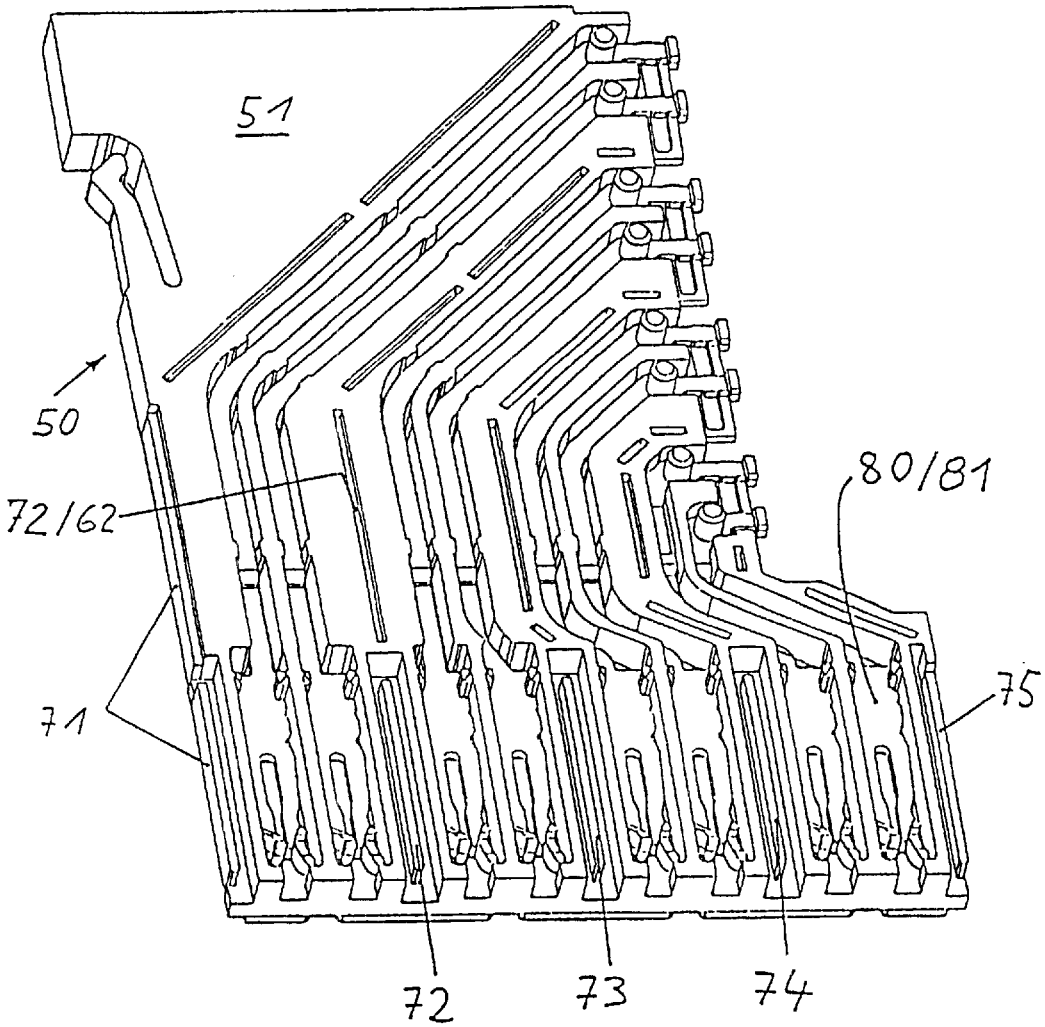
FIG. 9 the base body of the edge connector according to FIG. 5 with inserted shielding sheet resting against the bottom as well as contact springs inserted into the base body.

FIG. 9 shows an illustration in which the shielding sheet 70 is arranged below the base body 50 and the contact springs 80 are inserted into the channels 52 to 54 provided in the base body 50. As can be taken from this illustration, the stays 71 to 75 of the shielding sheet 70 project into the penetrations 61 to 65 or lateral cutouts 57 to 59 provided within the base body 50 so that a contact spring 80 is shielded substantially over its entire longitudinal area, respectively, a group of contact springs 80, which is comprised here of only two contact springs 80, is shielded, in addition to the upper and lower shielding, also laterally.

Figure 10:
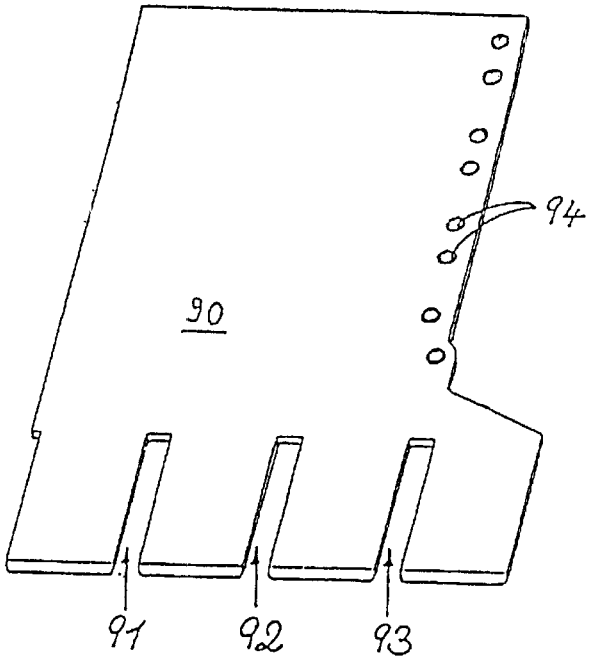
FIG. 10 a special cover for the edge connector according to FIG. 5.

In FIG. 10 the individual part of the upper cover 90 of the edge connector 40 is illustrated. In the middle and rearward part to the right, holes 54 are provided, which with respect to the number and position, match the pins 55 of the base body 50. Beginning at the end face, slots 91, 92, and 93 extend substantially parallel to the lateral edge into the body of the upper cover 90. These slots 91 to 93 correspond with the grooves 66 of the base body 50 and are approximately of the same width and length as those 66.

Figure 11:
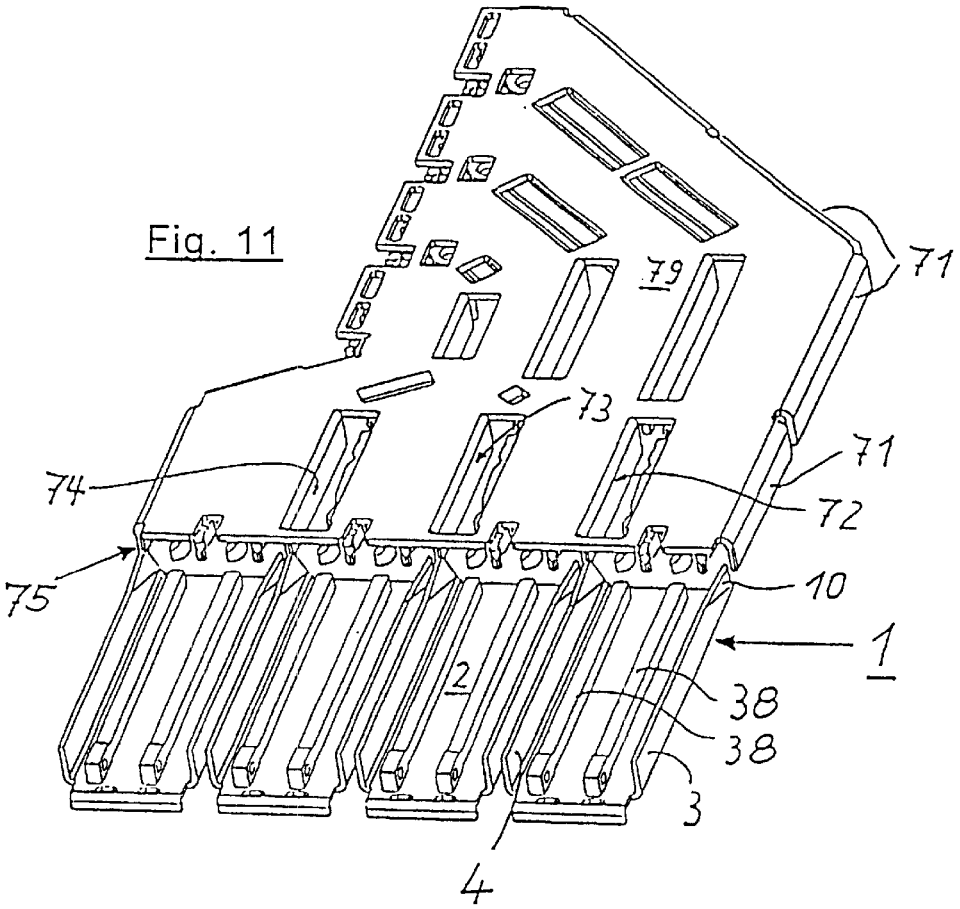
FIG. 11 the contact and shielding elements of the new plug-in connector according to FIG. 1 in a position directly before the plug-in step wherein the further components of the jack-in-blade strip and the edge connector are not shown.
Figure 12:
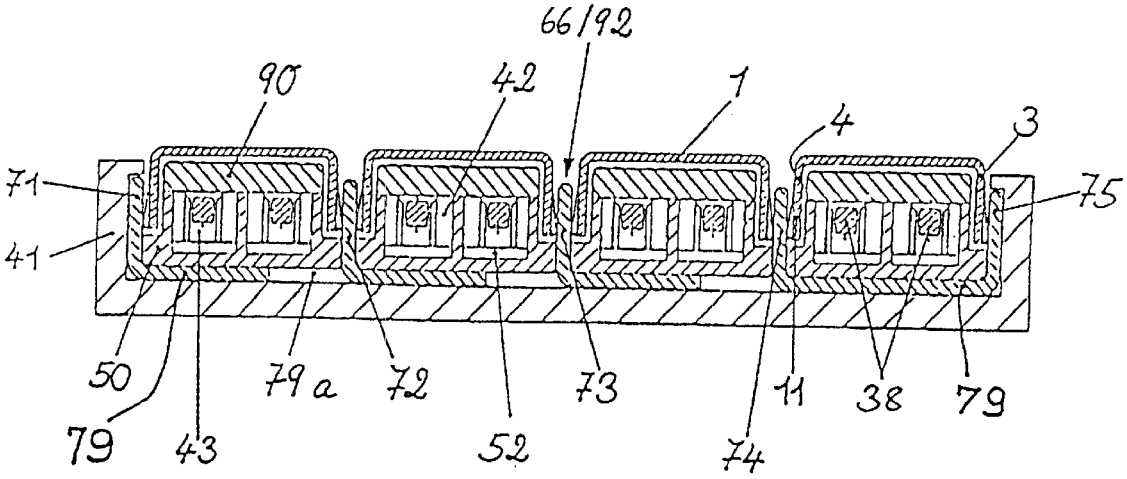
FIG. 12 shows a partial cross-section of a new plug-in connector according to FIG. 1 with completely inserted edge connector.

FIG. 11 shows an embodiment in which the contact elements and elements of the new shielding group are positioned in a position directly before the plug-in step, wherein the further components of the jack-in-blade strip and the edge connector are not shown in order to facilitate the illustration. Relative to the illustration in FIG. 5, the imaginary edge connector 40 is rotated by 180° so that the right side of the edge connector 40 according to FIG. 5 is positioned to the left in FIG. 12. In this view, several base parts 1 are shown which shield two contact pins 38, respectively. The oppositely positioned sidewalls of neighboring base parts 1 contacted the shielding sheet 70 at their angled stays 71, 72, 73, 74 or 75. After complete insertion has been carried out, the contact elements connected to one another of the plug-in connection, i.e., the contact pins 38 and the respective matching contact springs 80, are surrounded completely in pairs by a base part 1 and a correspondingly positioned, also U-shaped area of the shielding element. Such a shielded positioning is illustrated in FIG. 12. The plug-in contacts in the contact area are transversely sectioned; the Figure shows a detail of a plug-in connection. Shown are the area of the shielding sheet with its planar body 79 and the angled stays 71 to 75, areas of the basic body 50, areas of the upper cover 90, areas of the base parts 1, contact pins 38, forward channels 52, partial areas 42, 43 of the housing 41, partial areas of the slots 91, 92 and 93 as well as of the grooves 66; moreover, openings 79a resulting from the angled stays in the planar body part 79 which, with respect to the effectiveness of the inner shielding, are of no concern. The contact pins 38, respectively, the respective group of the contact pins 38 is encapsulated with respect to shielding-technological aspects by the novel shielding group, i.e., the corresponding area of the planar body 79 of the shielding sheet 70, by the two neighboring angled stays, for example, stay 71 and stay 72, as well as the base part 1 that can be pushed therebetween, i.e., its sidewalls 3 and 4 as well as its back wall 2, relative to other contact pins 38 or groups of contact pins 38.

Figure 13:
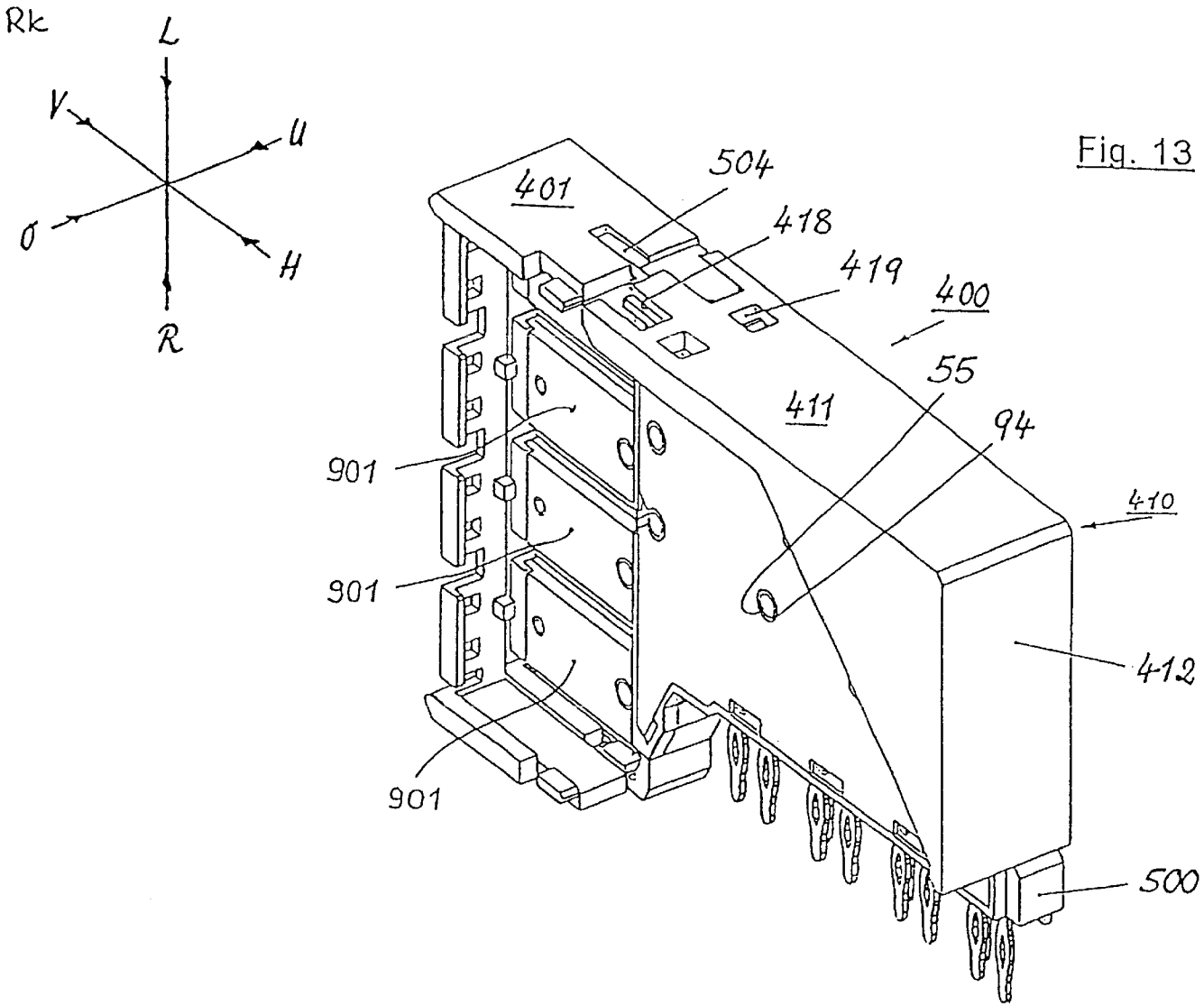
FIGS. 13 to FIG. 18 show a further new embodiment variant for an edge connector with newly configured shielding, preferably a two-row edge connector.

In FIGS. 13 to 18 a further advantageous embodiment of the inventive basic idea is illustrated. In these Figures a two-row further edge connector 400 is shown in different perspective views and different stages of assembly. As in FIG. 4, in FIG. 13 a coordinate system is also provided with which the viewing directions are defined. FIG. 13 shows the further edge connector 40 in the assembled state. For improving illustration, a row of contact springs together with the corresponding base bodies and shielding sheets is not illustrated. The further edge connector 400 is comprised of a front housing part 401, a rearward housing part 410 as well as two further base bodies 500. Each base body 500 receives a row of contact springs 80, respectively, together with the corresponding shielding sheet and the upper cover. The central and rearward area of the right side of this further edge connector 400 is recessed, like the edge connector 40, slightly to the left; this is done also for the purpose of connecting a circuit board. On the left side 411 in the rearward housing part 410 two locking holes 419 are provided into which a central locking hook 507 of one of the two further base bodies 500 can snap into place, respectively. Moreover, in front of each locking hole in the direction toward the front housing part 401 a profiled groove 418 is provided which penetrates the forward end face of the rearward housing part 410 and is provided for receiving a nose 506 of the further base body 500. The rearward wall 412 covers substantially the rearward body surface 501 of the further base body 500 and secures by means of a correspondingly shaped inner configuration the further basic body 500 at a second location so that this further base body is not only secured by means of the body points 506, 507 in connection with the forwardly positioned body points 418, 419 of the rearward housing 410. The further details are illustrated in FIGS. 14, 16, 17, and 18. In this edge connector 400 the same contact springs 80 and the same shielding sheet 70 are used which also have been used in connection with the aforedescribed edge connector 40. The channels 51 to 53 for receiving the contact springs 80 are of the same configuration. In comparison to the edge connector 40, in this further edge connector 400 whose further base body 500 with respect to the design of its housing as well as its locking action, is configured differently. The housing is divided into a rearward housing part 410 and a front housing part 401, i.e., into two separate housing parts so that at least manufacturing-technological advantages result. The front housing part 401 is illustrated in detail in FIG. 15. It has a forward front 42 which has also sleeve-shaped inlets 43 which are arranged adjacently in a row and has grooves 44 which separate the inlets 43 into groups of two inlets 43. Moreover, in the front part 42 a transverse slot 402 is provided which extends from the left side part 404 to the right side part 405 and is arranged parallel displaced between the two rows of inlets 43. In connection with the groove 44 this transverse slot 402 makes possible the insertion of base parts 1 arranged in a row in the jack-in-blade strip 30. For guiding and forward lateral positioning of the completely furnished further base bodies 500 at the inner side in the forward housing part 401, in a row and spaced apart from one another, stops 407 are provided as well as depressions 408 and 409 in the inner area of the side parts 404 and 405. Moreover, locking holes 406 are provided in the side parts 404 and 405 for locking with the further base body 500 in which the locking hooks 504 and 505 of the further base body 500 will lock into place upon insertion.

Figure 14:
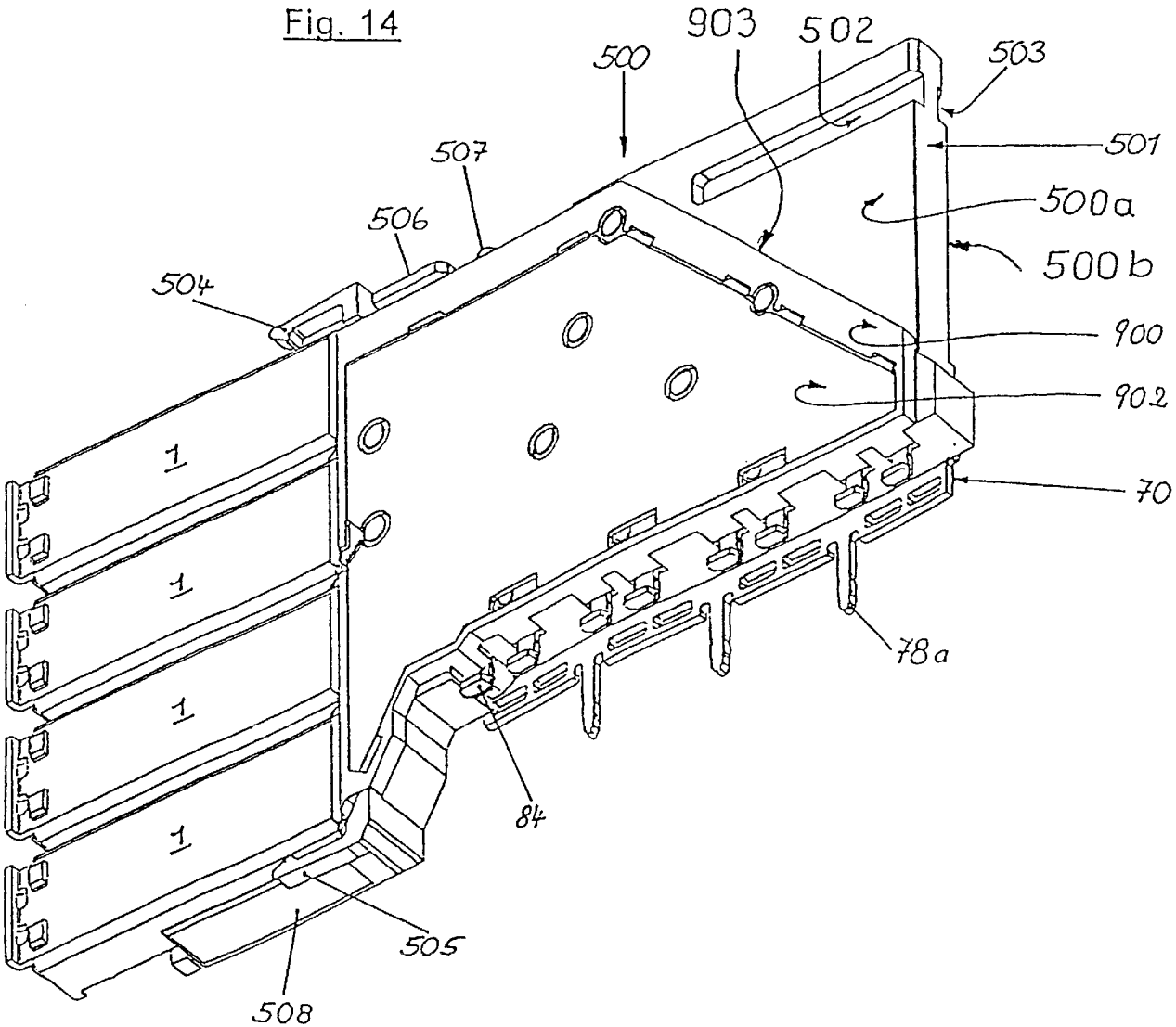
Figure 16:
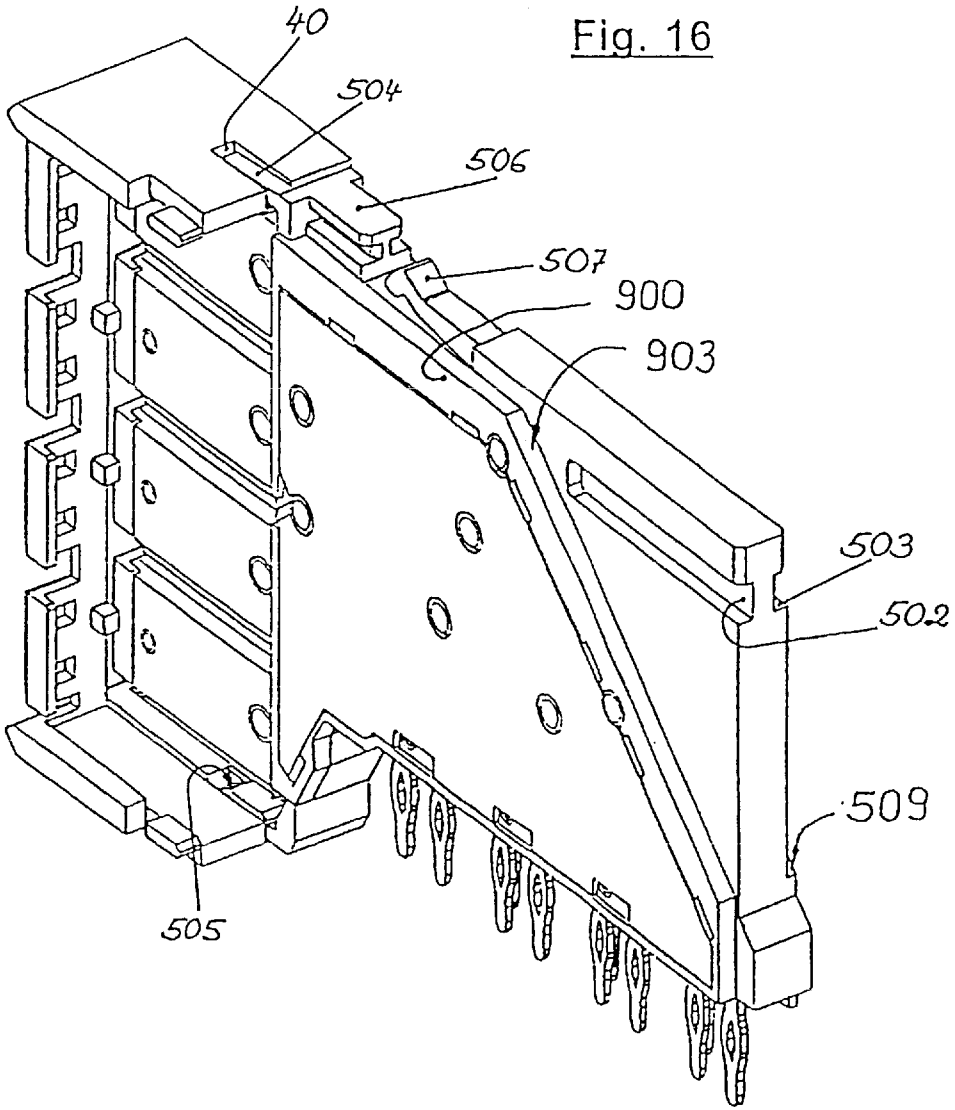
Figure 15:
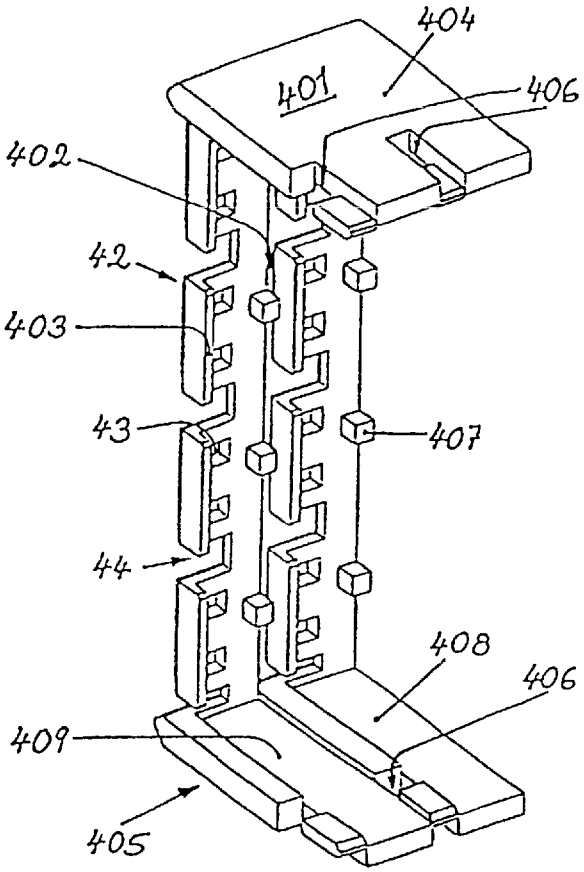

In FIGS. 16 and 14 as well as 18 in addition to further components a completely furnished basic body 500 is illustrated. Since the inner parts of this further basic body 500, i.e., the contact springs 80, the shielding sheet 70 as well as substantially the base body, i.e., the area receiving the contact springs 80, resemble the corresponding area of the edge connector 40, which has been described already above, these details will not be explained in more detail in this context. To the left and to the right, the base body 500 is provided at its respective front area with a left locking hook 504 and a correlated nose 506 as well as a central locking hook 507 and has at the right side a right locking hook 504 with a correlated guiding pin 508. In the rearward contact-free area grooves 502 and 503, starting at the upper surface 500*a* and the lower surface 500*b*, are provided in the body 500 which penetrate its rearward body surface 501. The closure of the further base body 500 together with the inserted contact springs 80 from above is realized by a further upper cover 900. This further upper cover 900 has a rearward slanted body edge 903. The further upper cover is provided with a peripheral rim, not identified, which surrounds a depression, not identified, in the same 900 in which a shielding part 902 is received. The depression is selected such that the peripheral rim projects slightly past this shielding part so that in the case of adjacently arranged, completely furnished further base bodies 500 no body contact can result between neighboring shielding parts 902. The further upper cover 900 has an insulating effect. In order for the front area of the contact springs 80, the spring parts 81, to be insulated relative to other contacts, the further upper cover 900 has a corresponding number of stay-shaped tabs which project up to the inner side of the front part 42 of the front housing part 401. In FIG. 14, these tabs 901 are covered by the illustrated base parts 1 which 1 complete the electric shielding of the front area of the contact springs 80.

Figure 17:
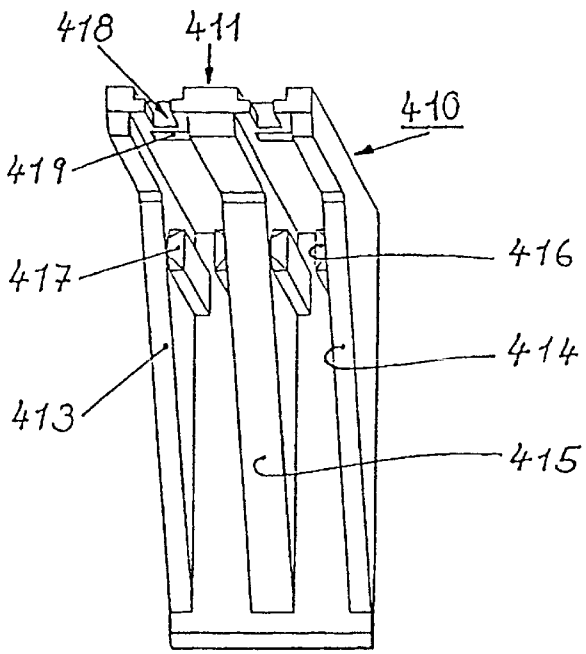

In the illustration according to FIG. 16, the front housing part 401 is connected to a further base body 500 wherein the locking hooks 504 and 505 are snapped into place in the corresponding locking holes 406. In FIG. 17 the rearward housing part 410 is illustrated in a perspective view wherein the viewing direction of the viewer extends from the front to the rear and the viewer views the rearward housing part 410. Starting at the back wall 412, a left wall 411, a lower wall 413, an upper wall 414 as well as a rib 415 arranged centrally between the latter project to the front. The front surfaces of these walls 413, 414, and 415 are shaped according to the extension of the slanted body edge 903 of the further upper cover. At inner sides of the walls 413, 414, and 415 guiding strips 416 and 417 are provided extending toward the left wall 411. When inserting the rearward housing part 410, these guiding strips 416 and 417 are inserted into the grooves 402 and 403 and secure the further base body 500 also in its rearward area. In comparison to the configuration of known edge connectors this fixation is new. On the lower side 500*b* of the further base body 500, in analogy to the slanted body edge 903 of the further upper cover, a guide stay 509 is provided which matches the lower wall 413 of the rearward housing part 410. The lower surface 500*b* of the further base body 500 is provided with a depression for receiving the shielding sheet 70 in the area of the channels receiving the contact springs with penetrations for guiding through the angled stays of the shielding sheet 70 as well as the guide stays 509 so that the outer lower surface 500*b*, when viewed laterally, projects past the outer surface of the shielding sheet 70.

Figure 18:
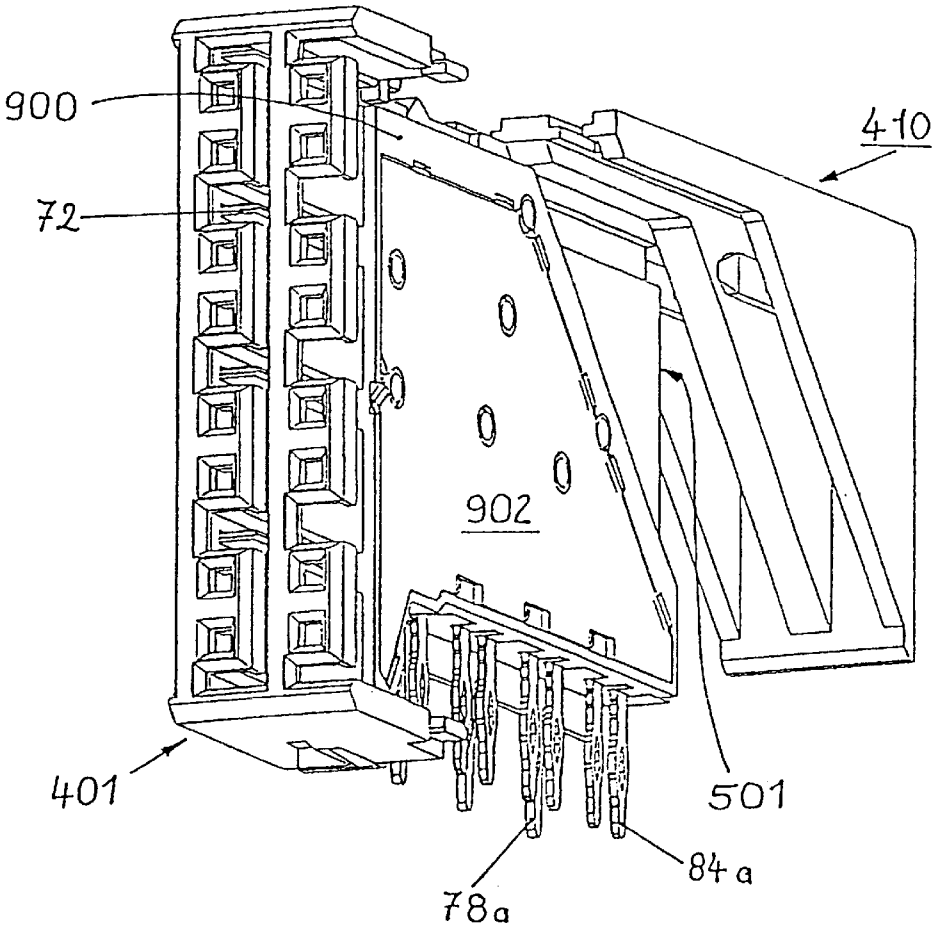

In FIG. 18 in the front housing part 401*a* of further furnished base body 500 is inserted and locked. The rearward housing part 410 is moved for mounting of the further edge connector 400 to the front in the direction toward the front housing part. For reasons of facilitating the illustration, the second further base body 500 is not shown. It can be clearly seen that the rearward body surface 501 of the further base body 500 is inserted between the lower wall 413 and the centrally arranged rib 415 into the rearward housing part 410. The completely inserted rearward housing part 410 together with completed locking action is illustrated in the already described FIG. 13. The thickness of the lower wall 413 and of the upper wall 414 is selected such that their outer surface is positioned in the same plane as the outer surface of the furnished further base body 500, respectively, is positioned slightly external thereto so that when successively arranging several multi-row edge connectors according to this embodiment, respectively, when positioning them adjacently to one another, for example, single-row edge connectors, as illustrated, for example, in FIG. 5, possibly only housing parts with insulating effect will come to rest against one another or will contact one another when the inserted edge connectors are moved possibly in the lateral direction out of their nominal position.

All features mentioned in the above description as well as features that can be taken only from the drawing are further components of the invention even though they might not be particularly emphasized and, in particular, not mentioned in the claims.

The invention is not limited to the described embodiments but is modifiable within the context of the disclosure in many ways.

LIST OF REFERENCE NUMERALS

1 base part (u-shaped rail)
2 back wall
3, 4 sidewalls
5 head area
6 foot area
7 stay-shaped recess
8 depressions
9 upper end area
10, 11 corner parts
12 slant (at the upper outer horizontal edge of part 10)
13 slant (at the upper, outer horizontal edge of part 11)
14 slant (at the upper inner edge of part 2)
15 bending lines
16 lateral displacement

17 thickness (of the parts 2, 3, and 4)
20 counterpart
21 back wall
22, 23 sidewalls
24 slant (at the lower inner edge of part 22)
25 slant (at the lower inner edge of part 21)
26 slant (at the lower inner edge of part 23)
30 jack-in-blade strip
31 socket
32 receiving holes (for contact pin; part 38)
33 receiving slots (for base part, part 1)
34, 35 sidewalls
36 inner wall (of part 37)
37 back wall
38 contact pins
40 edge connector
41 housing
42 front part
43 sleeve-shaped inlets
44 groove
45 locking hole
50 base body
50*a* upper surface
50*b* lower surface
51 contact-free area
52 front channel
53 central channel
54 rear channel
55 pins
56 openings
57, 58, 59 lateral cutouts
60 front surface
61 slot-shaped penetrations
62 slot-shaped penetrations
53 slot-shaped penetrations
64 slot-shape penetration
65 slot-shaped penetrations
66 grooves
67 locking hook
70 shielding sheet
71 angled stays
72 angled stays
73 angled stays
74 angled stays
75 angled stays
76 bulges
77 projections
78 cutout
78*a* guide pin
79 planar body
79*a* openings
80 contact spring
81 spring part
82 central part
83 end part
84 terminal tab
84*a* connecting pin (press-in pin)
85 hole
90 upper cover (with an insulating layer and a shielding layer)
91,92,93 slots
94 holes
400 further edge connector
401 front housing part
402 transverse slot
403 stays
404 left side part
405 right side part
406 locking hole
407 stops
408, 409 depressions
410 rearward housing part
411 left wall
412 rearward wall
413 lower wall
414 upper wall
415 rib
416, 417 guiding strip
418 profiled groove
419 locking hole
500 further base body
500*a* upper surface
500*b* lower surface
501 rearward body surface
502 groove (in part 50*a*)
503 groove (in part 50*b*)
504 left locking book
505 right locking hook
506 nose
507 central locking hook
508 guide pin
509 guiding stay
900 further upper cover
901 stay-shaped tab (formed on part 900, insulating)
902 shielding part
903 slanted body edge
RK coordinate system for orientation with respect to the body surfaces
V front
H back
L left
R right
O top
U bottom

What is claimed is:

1. Shielded plug-in connector, in particular, a multi-pole, single-row or multi-row plug-in connector, comprised of a jack-in-blade strip and edge connector, wherein the jack-in-blade strip has at least one first contact element and the edge connector at least one second contact element corresponding to the first contact element, wherein the edge connector, on or in its outer body areas, comprises, at least partially, shielding sheets, wherein a shielding of the plug-in connector is comprised of, in addition to the shielding sheets provided on the edge connector, a shielding group comprised of at least one first element, wherein this first element is arranged in the jack-in-blade strip, and wherein the first element of the shielding group is a base part (1) whose basic shape (1) is preferably a U-shaped rail, wherein the shielding sheets on the edge connector comprise a planar body (79) and angled stays (71–75), wherein two of the angled stays and a portion of the planar body (79) between the two angled stays (71–75) form a counterpart to the base part (1), and wherein the counterpart and the base part (1) together substantially encapsulate the at least one first and second contact elements.

2. Shielded plug-in connector according to claim 1, wherein the base part (1) laterally surrounds substantially almost completely at least one of the contact elements (38) of the jack-in-blade strip (30), while leaving open a preferably upwardly oriented gap, and shields the at least one of the contact elements (38) relative to other contact elements.

3. Shielded plug-in connector according to claim 1, wherein the base part (1) is fastened in a socket (31) of the jack-in-blade strip (30) and is open in the upward direction in the direction of the edge connector (40) and surrounds at least one of the contact elements (38) on three sides.

4. Shielded plug-in connector according to claim 1, wherein the base part (1) surrounds two neighboring contact elements (38) of a contact row of a jack-in-blade strip (30), wherein the two contact elements (38) are shielded relative to a neighboring contact element (38) of the contact row and also relative to the next row of contact elements (38).

5. Shielded plug-in connector according to claim 1, wherein the base part (1) comprises a back wall (2), a left sidewall (4) and a right sidewall (3) and is open in the head area (5) and in the foot area (6), respectively.

6. Shielded plug-in connector according to claim 5, wherein the sidewalls (3 and 4) in the foot area (6) are recessed somewhat in the direction toward the head area (5) so that at the back wall (2) a step (7) is formed.

7. Shielded plug-in connector according to claim 5, wherein the sidewalls (3 and 4) in the head area (5) each have a corner part (10 or 11) which are bent outwardly by a lateral displacement (16), respectively.

8. Shielded plug-in connector according to claim 6, wherein at least one depression (8) is provided in the area of the step (7) in the vicinity of the lower edge at the inner surface of the back wall (2).

9. Shielded plug-in connector according to claim 7, wherein the corner parts (10 and 11) are bent respectively outwardly about a bending line (15) so that the respective upper corner formed by the horizontal and vertical outer edges of the sidewall (3) or the sidewall (4) projects farthest outwardly.

10. Shielded plug-in connector according to claim 7, wherein the upper, outer horizontal edge of the corner parts (10, 11) is provided with a slant (12 or 13) extending along the aforementioned edge and wherein the upper, inner edge of the back wall also has a slant (14).

* * * * *